US008091151B2

(12) United States Patent
Johnson et al.

(10) Patent No.: US 8,091,151 B2
(45) Date of Patent: Jan. 10, 2012

(54) SAFETY VEST WITH INTEGRATED SAFETY HARNESS

(75) Inventors: Andrew Paul Johnson, St. Paul, MN (US); Nathan Michael Bohmbach, Apple Valley, MN (US)

(73) Assignee: D B Industries, Inc., Red Wing, MN (US)

( * ) Notice: Subject to any disclaimer, the term of this patent is extended or adjusted under 35 U.S.C. 154(b) by 752 days.

(21) Appl. No.: 12/145,817

(22) Filed: Jun. 25, 2008

(65) Prior Publication Data

US 2009/0320188 A1 Dec. 31, 2009

(51) Int. Cl.
*A41D 13/015* (2006.01)

(52) U.S. Cl. ..... 2/455; 2/102; 2/69; 2/95; 2/97

(58) Field of Classification Search ..... 2/455, 102, 2/69, 95, 97; 482/69; 182/3
See application file for complete search history.

(56) References Cited

U.S. PATENT DOCUMENTS

| | | | | |
|---|---|---|---|---|
| 5,531,292 | A | 7/1996 | Bell | |
| 5,960,480 | A | 10/1999 | Neustater et al. | |
| 6,035,440 | A | 3/2000 | Woodyard | |
| 6,253,874 | B1 * | 7/2001 | Casebolt et al. | 182/3 |
| RE37,394 | E * | 10/2001 | Woodyard | 2/102 |
| 6,892,395 | B2 * | 5/2005 | Schweer | 2/94 |
| 7,178,632 | B2 | 2/2007 | Casebolt et al. | |
| 2003/0213043 | A1 * | 11/2003 | Lewis et al. | 2/69 |
| 2004/0163156 | A1 | 8/2004 | Schweer | |

FOREIGN PATENT DOCUMENTS

WO WO 2005/117623 A1 12/2005

OTHER PUBLICATIONS

International Search Report from PCT/US2009/045584 mailed Aug. 17, 2009.
"Work Wear—3M Scotchlite™ Reflective Material", http://solutions.3m.com, 1 page (© 3M 2008).
"Guardian Fall Protection Performance Safety Gear—Construction TUX™ Vest Harness", http://www.guardianfall.com, 2 pages (© 2005-2008 Guardian Fall).
"Guardian Fall Protection Performance Safety Gear—Construction TUX™ Vest Harness—Features", http://www.guardianfall.com, 4 pages (© 2005-2008 Guardian Fall).
"Guardian Fall Protection Performance Safety Gear—Construction TUX™ Vest Harness—FAQ's", http://www.guardianfall.com, 2 pages (© 2005-2008 Guardian Fall).
"Construction TUX™ Vest Harnesses", Guardian Fall Protection 2007/08 Catalog, pp. 84-85 (© 2007/2008 Guardian Fall).

* cited by examiner

*Primary Examiner* — Gary L Welch
*Assistant Examiner* — Andrew W Collins
(74) *Attorney, Agent, or Firm* — IPLM Group, P.A.

(57) ABSTRACT

A safety vest for use with a safety harness, which includes first and second shoulder straps connected with a connector in an overlapping, crisscrossing relationship proximate a juncture. The first and second shoulder straps form an opening therebetween and below the connector. The vest includes an outer lining and an inner lining, and the first and second shoulder straps are at least partially positioned between the outer and inner linings. The inner lining extends from proximate an upper portion of the outer lining to proximate an intermediate portion of the outer lining. The inner lining includes a releasable connector configured and arranged to extend through the opening and releasably connect to the outer lining, wherein the releasable connector is disconnected and the inner lining is moved away from portions of the first and second shoulder straps to allow for inspection of the first and second shoulder straps.

16 Claims, 6 Drawing Sheets

SAFETY VEST WITH INTEGRATED SAFETY HARNESS

FIELD OF THE INVENTION

The present invention relates to a safety vest with an integrated safety harness.

BACKGROUND OF THE INVENTION

Various occupations place workers in precarious positions at relatively dangerous heights thereby creating a need for fall-arresting safety apparatus. Among other things, such apparatus usually include a safety line interconnected between a support structure and a worker working in proximity to the support structure. The safety line is typically secured to a full-body safety harness worn by the worker. Obviously, such a harness must be designed to remain secure about the worker in the event of a fall. In addition, the harness should arrest a worker's fall in as safe a manner as possible, placing a minimal amount of strain on the worker's body. Yet another design consideration is to minimize the extent to which workers may consider the harness uncomfortable and/or cumbersome.

In addition, there may also be a need for a worker to don a safety vest. Tasks that could necessitate donning a safety vest include construction, bridge construction and maintenance, utility work, aircraft work, and offshore work. Safety vests are commonly used by workers to make the workers more visible, protect the workers' garments, provide additional pockets, keep the workers warm, and other various reasons.

Some prior art safety vests have safety harnesses incorporated into them, however, it is typically difficult to inspect the safety harnesses. Therefore, these prior art safety vests are not very user friendly.

The present invention addresses the problems associated with prior art safety vests with integrated safety harnesses and provides for a more user friendly safety vest with an integrated safety harness.

SUMMARY OF THE INVENTION

One aspect of the present invention provides a safety vest for use with a safety harness, which includes a first shoulder strap and a second shoulder strap connected with a connector in an overlapping and criss-crossing relationship proximate a juncture. The first and second shoulder straps form an opening therebetween and proximate below the connector. The vest includes an outer lining and an inner lining, and the first and second shoulder straps are at least partially positioned between the outer and inner linings. The inner lining extends from proximate an upper portion of the outer lining to proximate an intermediate portion of the outer lining. The inner lining includes a releasable connector configured and arranged to extend through the opening and releasably connect to the outer lining, wherein the releasable connector is disconnected and the inner lining is moved away from portions of the first and second shoulder straps to allow for inspection of the first and second shoulder straps.

Another aspect of the present invention provides a safety vest with an integrated safety harness comprising first and second shoulder straps and a vest. The first and second shoulder straps are connected with a connector in an overlapping, criss-crossing relationship proximate a juncture, and the first and second shoulder straps form an opening therebetween and proximate below the connector. The vest includes an outer lining and an inner lining, and the first and second shoulder straps are at least partially positioned between the outer and inner linings. The inner lining extends from proximate an upper portion of the outer lining to proximate an intermediate portion of the outer lining, and the inner lining includes a releasable connector configured and arranged to extend through the opening and releasably connect to the outer lining. The releasable connector is disconnected and the inner lining is moved away from portions of the first and second shoulder straps to allow for inspection of the first and second shoulder straps.

Another aspect of the present invention provides a method of inspecting a safety harness integrated with a safety vest. The safety harness includes a first shoulder strap and a second shoulder strap connected with a connector in an overlapping, criss-crossing relationship proximate a juncture, and the first and second shoulder straps form an opening therebetween and proximate below the connector. The safety vest includes an outer lining and an inner lining, and the first and second shoulder straps are at least partially positioned between the outer and inner linings. The inner lining extends from proximate an upper portion of the outer lining to proximate an intermediate portion of the outer lining, and the inner lining includes a releasable connector configured and arranged to extend through the opening and releasably connect to the outer lining. The releasable connector is disconnected, and the inner lining is moved away from portions of the first and second shoulder straps. The vest is substantially right side out during inspection of the portions of the first and second shoulder straps.

DETAILED DESCRIPTION OF A PREFERRED EMBODIMENT

Figure 1:
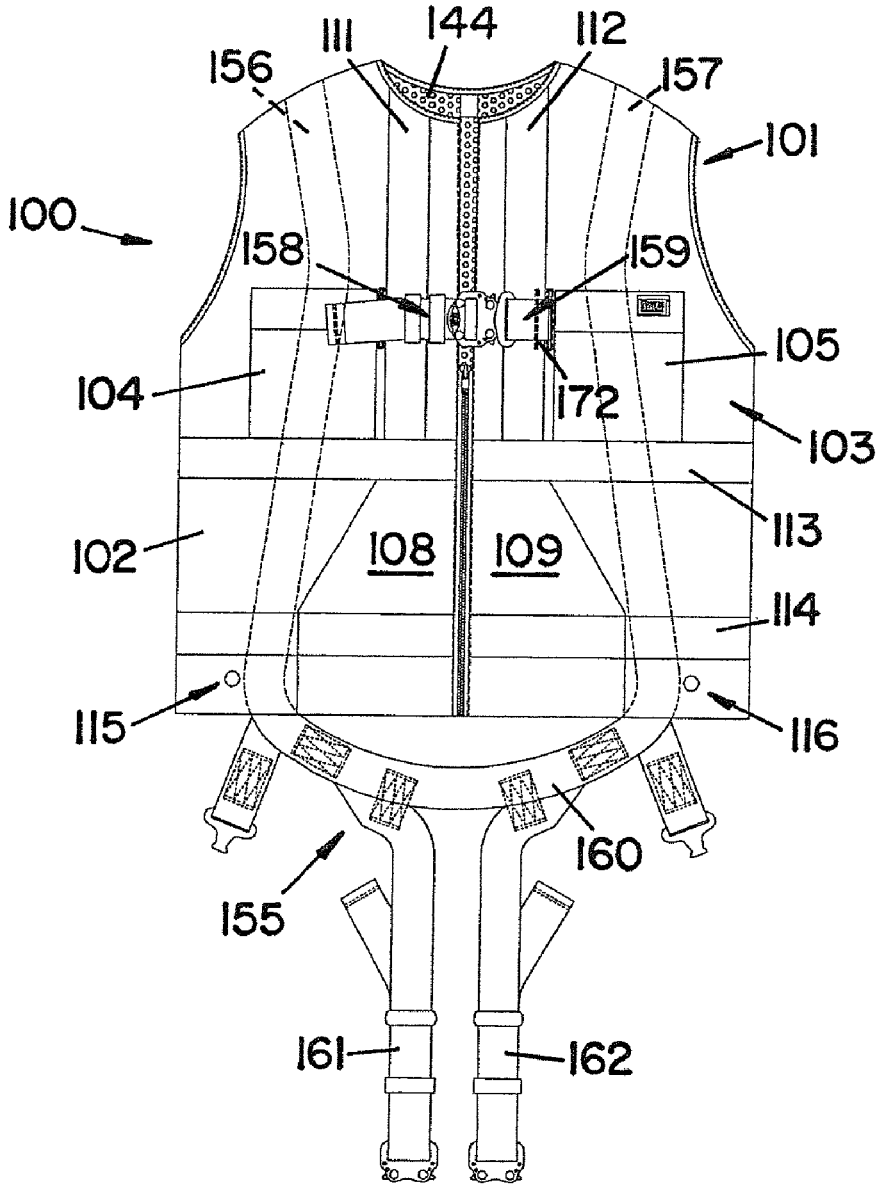
FIG. 1 is a front view of a safety vest with an integrated safety harness constructed according to the principles of the present invention.
Figure 2:
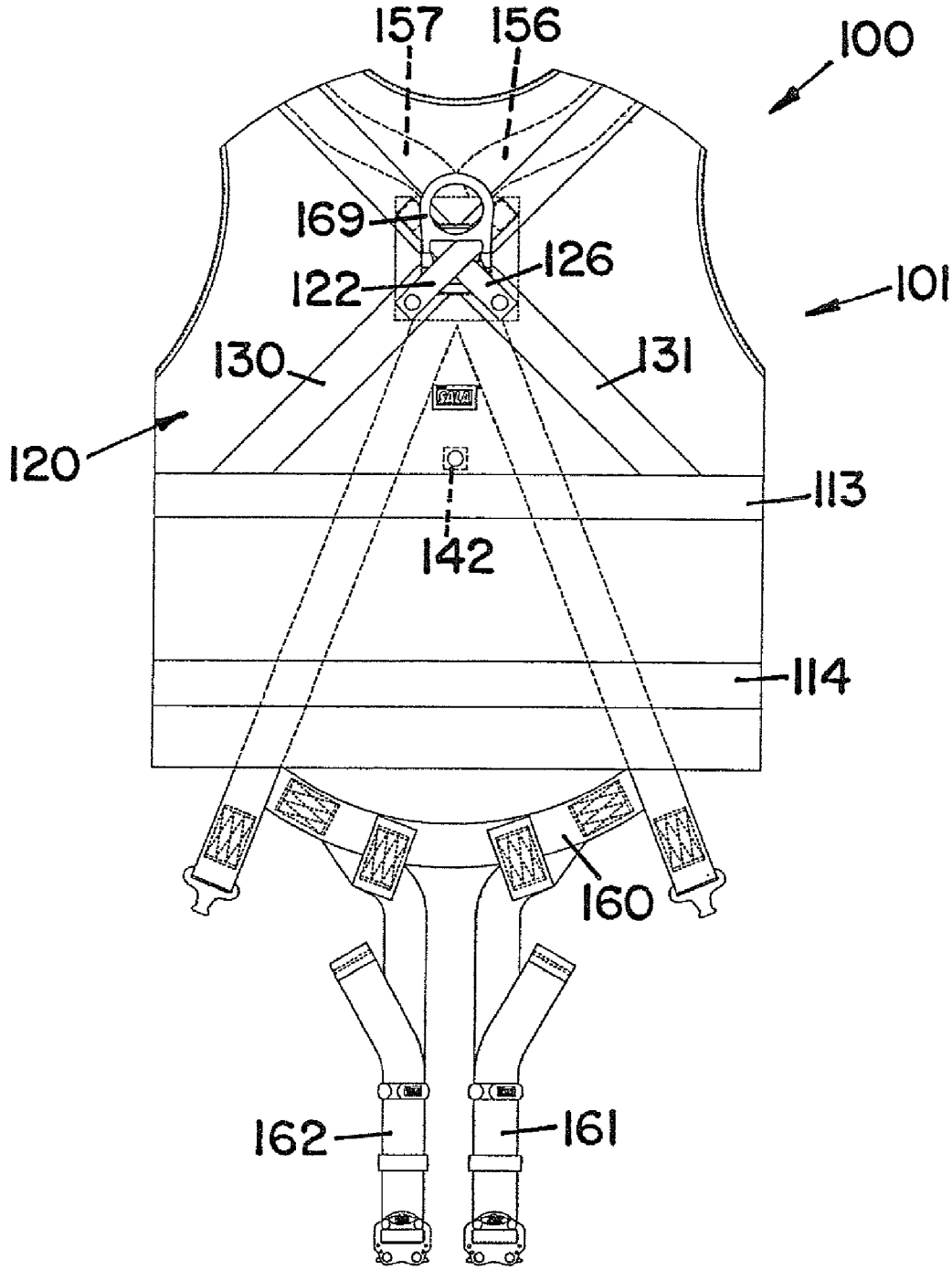
FIG. 2 is a rear view of the safety vest with an integrated safety harness shown in FIG. 1.

A preferred embodiment safety vest constructed according to the principles of the present invention is designated by the numeral 100 in the drawings. The orientation of the safety vest 100 is being described herein relative to a worker donning the safety vest 100.

Figure 3:
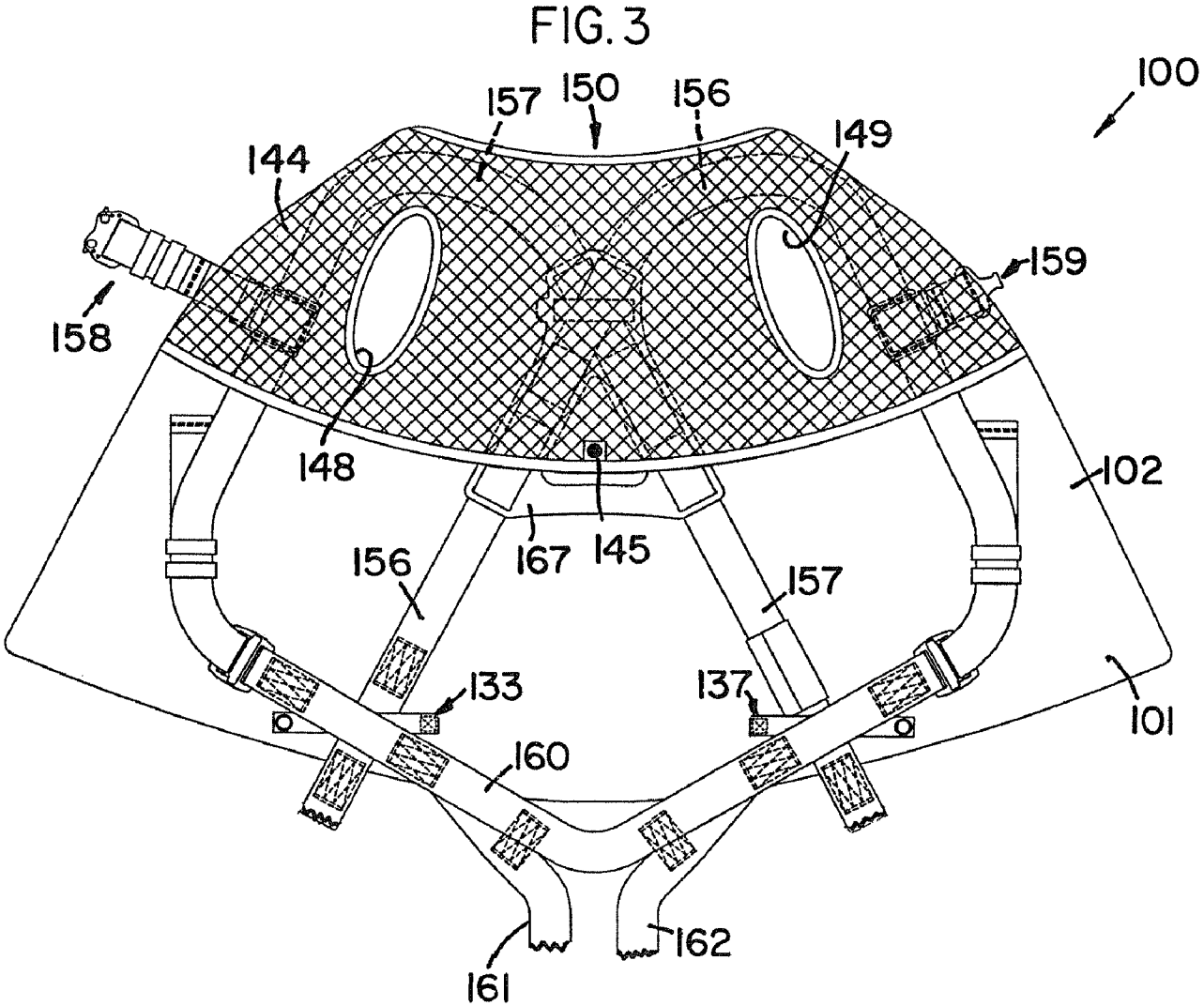
FIG. 3 is a front view of the safety vest with an integrated safety harness shown in FIG. 1 with the safety vest open to show the interior of the safety vest.

The safety vest 100 includes a vest portion 101 and a safety harness portion 155. As shown in FIG. 3, the vest portion 101 includes an outer lining 102 and an inner lining 144. The outer lining 102 includes a front 103 and a rear 120. The front 103 includes a right panel 103*a* and a left panel 103*b* releasably connectable from proximate the bottom to the intermediate portion with a zipper 110, and the rear 120 is connected to the right and left panels 103*a* and 103*b* proximate the tops and the sides of the right and left panels opposite the zipper 110. The front 103 and the rear 120 define a neck opening 150 and right and left armholes 148 and 149.

The outer surface of the right panel 103*a* includes a first breast pocket 104 and a first pouch pocket 108, and the outer surface of the left panel 103*b* includes a second breast pocket 105 and a second pouch pocket 109. The first and second breast pockets 104 and 105 are proximate the intermediate portion of each respective panel, and the first and second pouch pockets 108 and 109 are proximate the inner bottom side of each respective panel. The breast pockets 104 and 105 include openings proximate the tops, and the pouch pockets 108 and 109 include openings proximate top portions of the sides. Preferably, the breast pockets 104 and 105 include flaps that cover the openings proximate the tops, and the flaps can be lifted up to access the openings. The right panel 103*a* includes a first slit 106 proximate the upper left side of the first breast pocket 104, and the left panel 103*b* includes a second slit 107 proximate the upper right side of the second breast pocket 105.

A first horizontal reflective strip 113 extends horizontally about the outer lining 102 proximate below the breast pockets 104 and 105, and a second horizontal reflective strip 114 extends horizontally about the outer lining 102 proximate below the openings of the pouch pockets 108 and 109. The zipper 110 interrupts the first and second horizontal reflective strips 113 and 114. A first vertical reflective strip 111 extends upward from proximate the first horizontal reflective strip 113 between the slit 106 and the zipper 110 to proximate the neck opening 150, and a second vertical reflective strip 112 extends upward from proximate the first horizontal reflective strip 113 between the slit 107 and the zipper 110 to proximate the neck opening 150.

Figure 5:
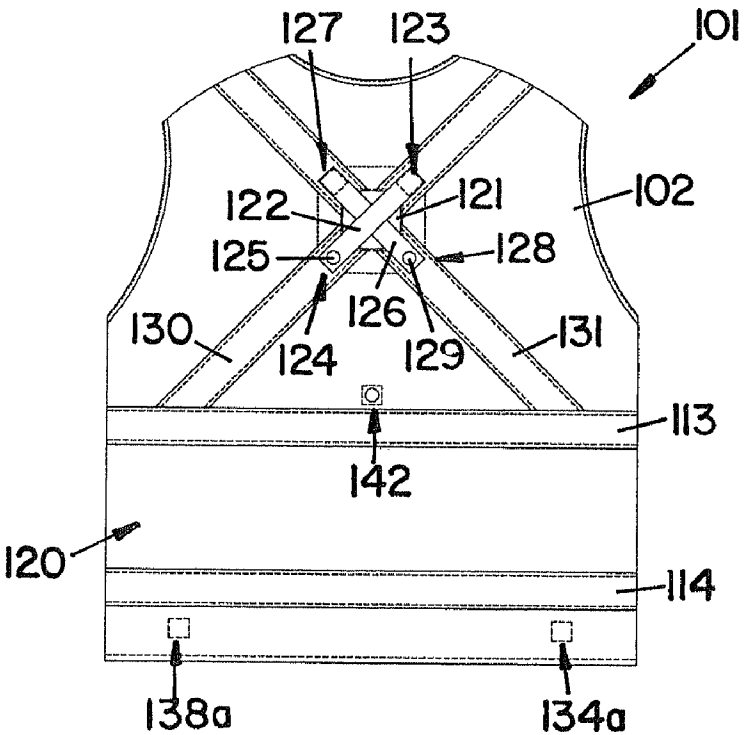
FIG. 5 is a rear view of the safety vest shown in FIG. 1.

The rear 120 includes a first diagonal reflective strip 130 that extends from proximate the right shoulder portion diagonally to the first horizontal reflective strip 113 proximate the left side and a second diagonal reflective strip 131 that extends from proximate the left shoulder portion diagonally to the first horizontal reflective strip 113 proximate the right side. Where the first and second diagonal reflective strips 130 and 131 would intersect, the rear 120 includes an aperture 121, which interrupts the first and second diagonal reflective strips 130 and 131. Although the aperture 121 is preferably square-shaped, any suitable size and shaped could be used. Proximate the first diagonal reflective strip 130 a first strap 122 extends diagonally over the aperture 121, and proximate the second diagonal reflective strip 131 a second strap 137 extends diagonally over the aperture 121. The first strap 122 includes a first end 123, which is connected to the rear 120 proximate the upper right corner of the aperture 121, and a second end 124, which includes a snap portion 125 releasably connectable to a mating snap portion proximate the lower left corner of the aperture 121. The second strap 126 includes a first end 127, which is connected to the rear 120 proximate the upper left corner of the aperture 121, and a second end 128, which includes a snap portion 129 releasably connectable to a mating snap portion proximate the lower right corner of the aperture 121. This is shown in FIG. 5.

Figure 4:
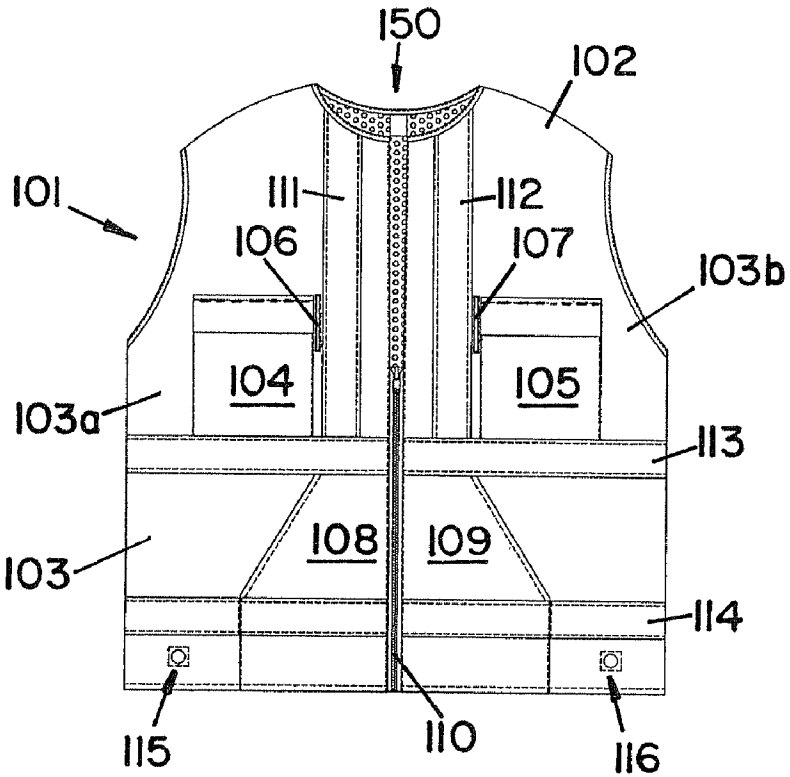
FIG. 4 is a front view of the safety vest shown in FIG. 1.
Figure 6:
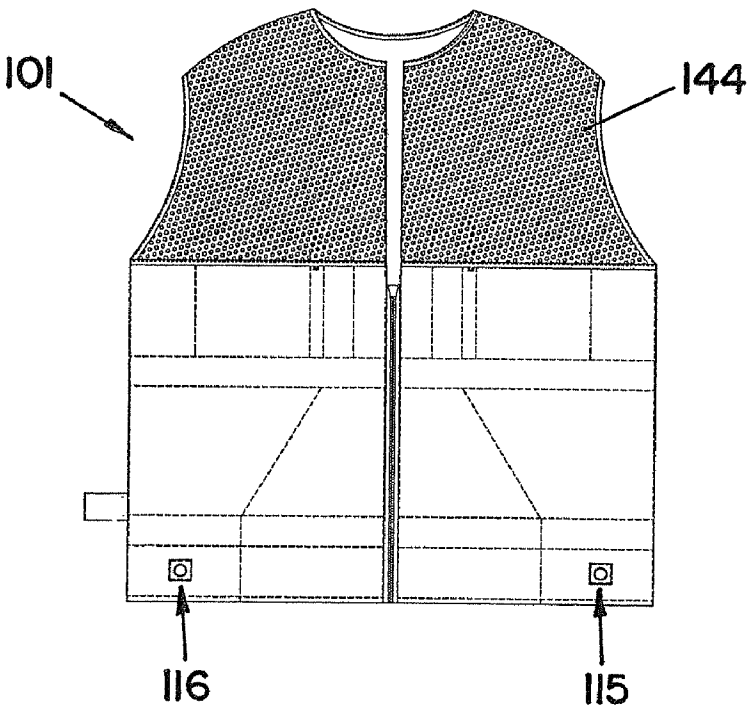
FIG. 6 is a front view of the safety vest shown in FIG. 1 turned inside out.

Proximate the bottom right and left sides of the right and left panels 103*a* and 103*b* are a first snap portion 115 and a second snap portion 116, respectively, as shown in FIGS. 4 and 6. The first and second snap portions 115 and 116 are configured and arranged to releasably mate with snap portions 136 and 140, which are connected to securing straps 133 and 137.

Figure 7:
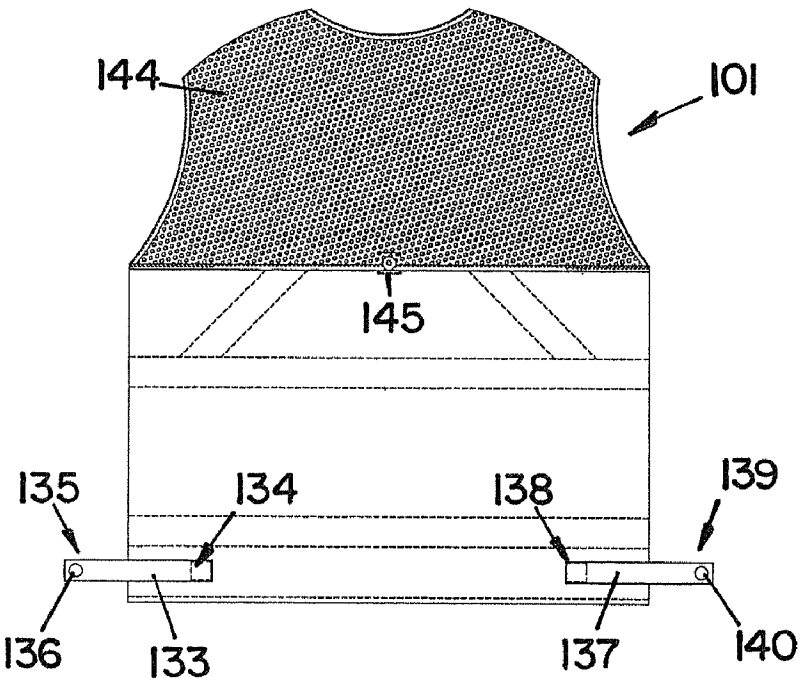
FIG. 7 is a rear view of the safety vest shown in FIG. 1 turned inside out.

As shown in FIG. 7, the inner surface of the rear 120 includes the first securing strap 133 proximate the lower right side and a second securing strap 137 proximate the lower left side. The first strap 133 includes a first end 134 and a second end 135. The first end 134 is connected to the rear 120 with stitching 134*a* and the second end 135 includes a snap portion 136. The second strap 137 includes a first end 138 and a second end 139. The first end 138 is connected to the rear 120 with stitching 138*a* and the second end 139 includes a snap portion 140. The snap portion 136 of the first strap 133 is configured and arranged to releasably mate with the first snap portion 115, and the snap portion 140 of the second strap 137 is configured and arranged to releasably mate with the second snap portion 116. The rear 120 also includes a snap portion 142 between the aperture 121 and the first horizontal reflective strip 113, preferably more proximate the first horizontal reflective strip 113.

The inner lining 144 of the vest portion 101 corresponds with the upper portion of the outer lining 102 and terminates proximate the middle portion of the outer lining 102. Preferably, as shown in FIG. 3, the inner lining 144 terminates proximate below the snap portion 142 and the armholes 148 and 149, and the inner lining 144 includes a snap portion 145 that releasably mates with the snap portion 142. Although snap portions 142 and 145 are shown, any suitable releasable connector could be used such as snap portions, hook and loop fasteners, magnets, and buttons and button holes.

The outer lining 102 is preferably made of a lightweight polyester material to provide breathability for enhanced comfort. The outer lining 102 could also be made of a mesh material that helps keep the worker cooler during warm weather or a cotton material to create a soft, comfortable vest that helps keep the worker warmer during cold weather. The outer lining 102 could be made of any other suitable types of material. Further, the vest portion 101 preferably includes elastic binding around the armholes 148 and 149 and the neck opening 150 to increase comfort and reduce chafing.

The outer lining 102 could also be made of high visibility colors such as neon yellow and neon orange and could include reflective tape to meet ANSI and CSA standards for high visibility. A reflective tape such as 3M™ Scotchlite™ reflective material by 3M could be used. The reflective strips 111, 112, 113, 114, 130, and 131 are optional but should be used if high visibility is recommended or required.

The inner lining 144 is preferably made of a mesh material through which the harness portion 155 is visible. The mesh material is shown in FIGS. 6 and 7. To more clearly show the harness portion 155 through the inner lining 144, the inner lining 144 is shown in FIG. 3 with cross-hatching rather than a mesh material as shown in FIGS. 6 and 7. Any suitable type of material could be used for the inner lining 144.

Figure 8:
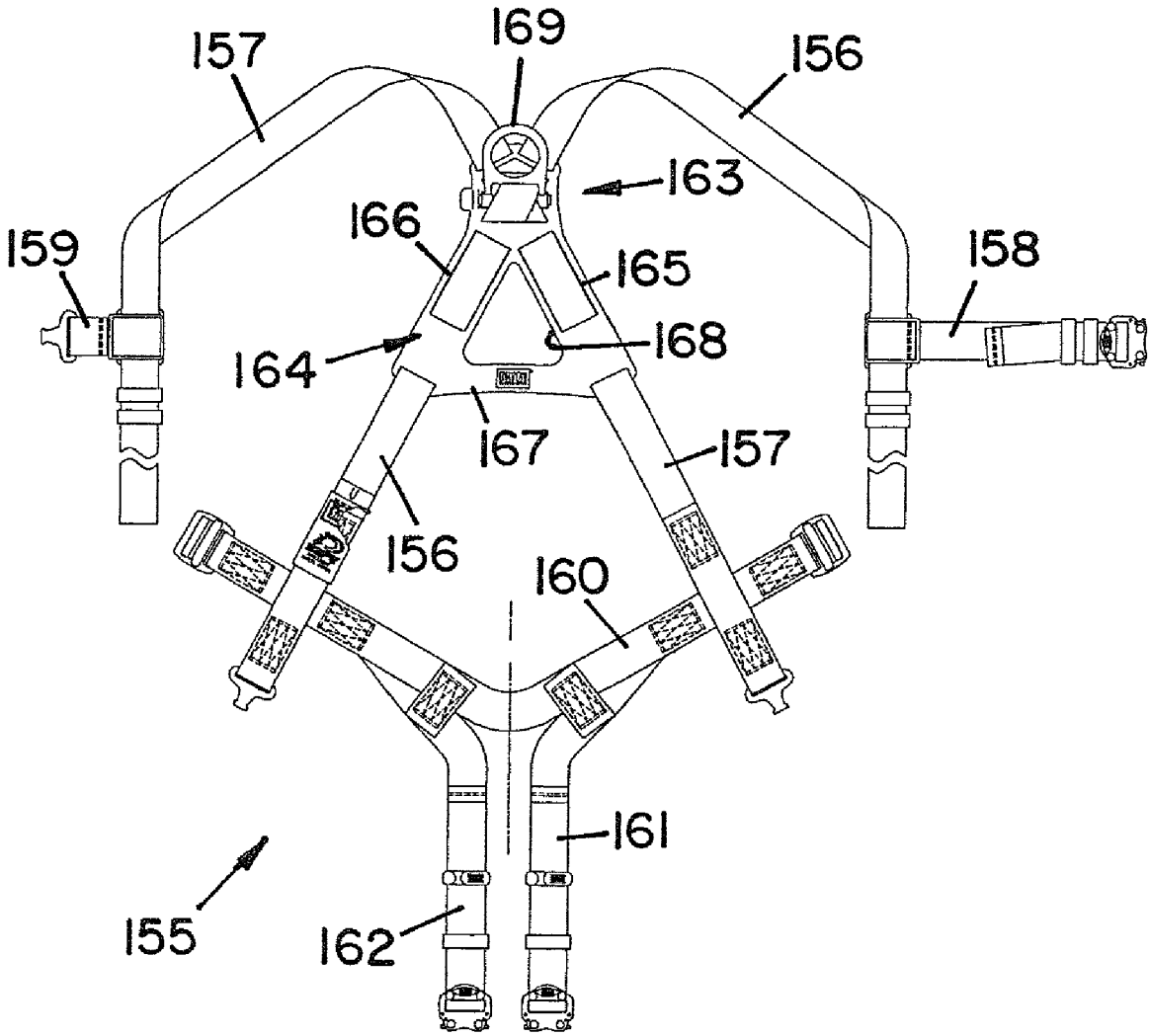
FIG. 8 is a rear view of the safety harness shown in FIG. 1.

Safety harnesses are well known in the art, and any suitable safety harness could be used with the present invention. An example of a suitable harness portion 155 is shown in FIG. 8. Generally, the harness portion 155 includes shoulder straps, a chest strap, a seat strap, and leg straps. Examples of suitable safety harnesses that could be used with the present invention include the safety harnesses disclosed in U.S. Pat. Nos. 6,253,874 and 7,178,632, which are incorporated by reference herein. It is recognized that safety harnesses including a strap interconnecting the shoulder straps below the dorsal D-ring to form an opening therebetween such as that disclosed in U.S. Pat. No. 5,531,292 could also be used.

The harness portion 155 includes a first shoulder strap 156 and a second shoulder strap 157 that pass over respective shoulders of a worker and overlap and criss-cross across the worker's back between the worker's waist and shoulders and extend generally parallel to one another across the worker's chest. Proximate the worker's chest, a first chest strap portion 158 is operatively connected to the first shoulder strap 156 and a second chest strap portion 159 is operatively connected to the second shoulder strap 157, and the first and second chest strap portions 158 and 159 are releasably connectable to interconnect the first and second shoulder straps 156 and 157. A seat strap 160 is operatively connected to the first and second shoulder straps 156 and 157 proximate their rear distal end portions, and the front distal end portions of the first and second shoulder straps 156 and 157 are releasably connectable to the respective distal end portions of the seat strap 160. A first leg strap 161 and a second leg strap 162 are operatively connected to the seat strap 160 between the first and second shoulder straps 156 and 157. The first leg strap 161 is releasably connectable to the rear distal end portion of the second shoulder strap 157, and the second leg strap 162 is releasably connectable to the rear distal end portion of the first shoulder strap 156.

Proximate the juncture of the overlapping and crisscrossing first and second shoulder straps 156 and 157, a dorsal assembly 163 including a back pad 164 and a D-ring 169 are operatively connected to the first and second shoulder straps 156 and 157. Preferably, the shoulder straps 156 and 157 are routed through slots in the back pad 164 and the D-ring 169 is held in place between the back pad 164 and the shoulder straps 156 and 157. The back pad 164 includes a first portion 165 extending downward proximate the second shoulder strap 157, a second portion 166 extending downward proximate the first shoulder strap 156, and a third portion 167 interconnecting the first and second portions 165 and 166 creating a generally triangular opening 168 therebetween. The portions 165, 166, and 167 are preferably integral with the back pad 164. The shoulder straps 156 and 157 are preferably connected to the portions 166 and 165, respectively, by being routed through slots in the portions 166 and 165 as is well known in the art. Although dorsal assembly 163 is shown, any suitable connector well known in the art could be used. Although it is preferred to include a connecting member interconnecting the shoulder straps 156 and 157 a distance below the connector to create an opening therebetween, and any suitable connecting member could be used, a connecting member is not necessary.

The harness portion 155 is positioned between the outer and inner linings 102 and 144. As shown in FIG. 3, the first shoulder strap 156 is positioned between the armhole 149 and the neck opening 150 and the second shoulder strap 157 is positioned between the armhole 148 and the neck opening 150. The D-ring 169 extends through the aperture 121 in the outer lining 102 and the straps 122 and 126 extend through an opening in the D-ring 169 to hold the D-ring 169 in place and prevent the D-ring 169 from slipping between the outer and inner linings 102 and 144. This allows the D-ring 169 to be easily accessible outside of the vest portion 101. The first chest strap portion 158 extends through the first slit 106 and the second chest strap portion 19 extends through the second slit 107 so that the chest straps can be connected and disconnected outside of the vest portion 101. Stitching 172 could be used to connect the second chest strap portion 159 to the outer lining 102.

The straps 133 and 137 hold the harness portion 155 proximate the junctures of the shoulder straps 156 and 157 and the seat strap 160 to the vest portion 101. The straps 133 and 137 could be positioned anywhere along straps 156 and 160 and straps 157 and 160, respectively, to reduce bunching of the vest portion 101 or to make the vest portion 101 more comfortable. The snap portion 142 of the outer lining 102 releasably mates with the snap portion 145 of the inner lining 144 to interconnect the outer and inner linings 102 and 144. Preferably, the snap portions 142 and 145 are positioned proximate the opening 168 of the harness portion 155 and extend therethrough when connected.

The safety vest 100 with a vest portion 101 and an integrated safety harness portion 155 allows the safety harness to be donned like a vest, which increases the ease of putting on the safety harness. The inner lining 144 and the various connections (slots 106 and 107, aperture 121 and straps 122 and 126, straps 133 and 137, snap portions 142 and 145) assist in holding the shape of the safety harness while allowing easy inspection of the safety harness's straps and other components.

In addition, the inner lining 144 allows easy inspection of the harness portion 155 because the snap portions 142 and 145 may be easily disconnected so that the inner lining 144 can be lifted or otherwise moved away from the harness portion 155 to expose the harness's straps. The vest portion 101 remains substantially right side out and does not need to be turned inside out for proper inspection. The straps 133 and 137 may also be easily disconnected to better inspect the harness's straps. To inspect the dorsal assembly 163, the straps 122 and 126 can be disconnected and the D-ring 169 pulled through the aperture 121.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A safety vest for use with a safety harness, the safety harness including a first shoulder strap and a second shoulder strap connected with a connector in an overlapping and crisscrossing relationship proximate a juncture, the first and second shoulder straps forming an opening therebetween and proximate below the connector, comprising:

a vest including an outer lining and an inner lining, the first and second shoulder straps being at least partially positioned between the outer and inner linings, the inner lining extending from proximate an upper portion of the outer lining to proximate an intermediate portion of the outer lining, the inner lining including a releasable connector configured and arranged to extend through the opening and releasably connect to the outer lining, wherein the releasable connector is disconnected and the inner lining is moved away from portions of the first and second shoulder straps to allow for inspection of the first and second shoulder straps;

the outer lining having a front and a rear, the rear of the outer lining having an aperture; and a first strap and a second strap configured and arranged to be selectively coupled across the aperture in a crossed fashion.

2. The safety vest of claim 1, wherein the releasable connector is selected from the group consisting of snap portions, hook and loop fasteners, magnets, and buttons and button holes.

3. A safety vest with an integrated safety harness, comprising:

a first shoulder strap and a second shoulder strap connected with a connector in an overlapping and criss-crossing relationship proximate a juncture, the first and second shoulder straps forming an opening therebetween and proximate below the connector;

a vest including an outer lining and an inner lining, the first and second shoulder straps being at least partially positioned between the outer and inner linings, the inner lining extending from proximate an upper portion of the outer lining to proximate an intermediate portion of the outer lining, the inner lining including a releasable connector configured and arranged to extend through the opening and releasably connect to the outer lining;

wherein the releasable connector is disconnected and the inner lining is moved away from portions of the first and second shoulder straps to allow for inspection of the first and second shoulder straps;

the outer lining having a front and a rear, the rear of the outer lining having an aperture; and a first and second strap configured and arranged to be selectively coupled across the aperture in a crossed fashion.

4. The safety vest of claim 3, further comprising a connecting member interconnecting the first and second shoulder straps a distance below the connector, the connecting member forming the opening between the first and second shoulder straps, the connector, and the connecting member.

5. The safety vest of claim 4, wherein the connecting member is integral with the connector and includes a first side, a second side, and a third side forming the opening.

6. The safety vest of claim 5, wherein the connector interconnects the first and second sides proximate the juncture, the first side extending along and operatively connected to the first shoulder strap, the second side extending along and operatively connected to the second shoulder strap, and the third side interconnecting the first and second sides opposite the connector.

7. The safety vest of claim 3, wherein the inner lining is made of a mesh material.

8. The safety vest of claim 3, wherein the outer lining includes a high visibility material.

9. The safety vest of claim 3, further comprising a first chest strap portion and a second chest strap portion interconnecting the first and second shoulder straps, the outer lining including a first slit and a second slit, the first chest strap portion extending through the first slit and the second chest strap portion extending through the second slit.

10. The safety vest of claim 3, further comprising a D-ring operatively connected to the first and second shoulder straps proximate the juncture, the outer lining including a D-ring aperture through which the D-ring extends for access to the D-ring outside of the vest.

11. The safety vest of claim 3, wherein the releasable connector is selected from the group consisting of snap portions, hook and loop fasteners, magnets, and buttons and button holes.

12. The safety vest of claim 3, wherein the outer lining includes a first securing strap and a second securing strap, the first securing strap releasably connecting the first shoulder strap proximate a bottom of the outer lining, the second securing strap releasably connecting the second shoulder strap proximate the bottom of the outer lining.

13. A method of inspecting a safety harness integrated with a safety vest, the safety harness including a first shoulder strap and a second shoulder strap connected with a connector in an overlapping and criss-crossing relationship proximate a juncture, the first and second shoulder straps forming an opening therebetween and proximate below the connector, the safety vest including an outer lining and an inner lining, the first and second shoulder straps being at least partially positioned between the outer and inner linings, the inner lining extending from proximate an upper portion of the outer lining to proximate an intermediate portion of the outer lining, the inner lining including a releasable connector configured and arranged to extend through the opening and releasably connect to the outer lining, the outer lining having a front and a rear, the rear of the outer lining having an aperture, and a first and second strap configured and arranged to be selectively coupled across the aperture in a crossed fashion, a dorsal assembly coupled to the first and second shoulder straps, the dorsal assembly including a D-ring extending through the aperture of the outer lining, comprising:

disconnecting the releasable connector;

moving the inner lining away from portions of the first and second shoulder straps, wherein the vest is substantially right side out; and inspecting the portions of the first and second shoulder straps;

disconnecting the first and second straps from across the aperture in the outer lining;

pulling the D-ring through the aperture in the outer lining; and inspecting the dorsal assembly.

14. The method of claim 13, further comprising positioning the releasable connector through the opening and connecting the releasable connector.

15. The safety vest of claim 3, wherein the first and second straps each have an end that is configured and arranged to be selectively disconnected from the outer lining.

16. The safety vest of claim 3, further comprising:

a first reflective strip; and a second reflective strip, the first and second reflective strips coupled to the outer lining in a crossed fashion, the first strap located proximate the first reflective strip and the second strap located proximate the second reflective strip.

* * * * *